United States Patent [19]

Biermann

[11] Patent Number: 4,996,925

[45] Date of Patent: Mar. 5, 1991

[54] TAMPING TOOLS

[76] Inventor: Paul Biermann, 14728-116 Avenue, Edmonton, Alberta, Canada, T5M 3G1

[21] Appl. No.: 359,724

[22] Filed: May 31, 1989

[30] Foreign Application Priority Data

Nov. 29, 1988 [CA] Canada ..... 584488

[51] Int. Cl.[5] ..... E01B 27/00

[52] U.S. Cl. ..... 104/10

[58] Field of Search ..... 104/10, 12; 404/133; 172/719, 753, 772; 173/139, 162.1

[56] References Cited

U.S. PATENT DOCUMENTS 3,301,335 1/1967 Snelling ..... 173/162.1

4,155,665 5/1979 Kaarlela ..... 172/772 X

*Primary Examiner*—Joseph F. Peters, Jr.

*Assistant Examiner*—Virna Lissi Mojica

*Attorney, Agent, or Firm*—Kenyon & Kenyon

[57] ABSTRACT

There is provided a new and useful tamping tool for a railway ballast tamping machine comprising: a shank comprising a shaft, means for fastening the shaft to a tamping machine, and, integral with the shaft, a foot including a first surface; a deformable stress equalizing pad; and a tamping pad adapted to be removably secured to the foot, the tamping pad having a cavity adapted to receive the foot therein, the cavity having a surface corresponding to the first surface of the foot and having at least one other surface corresponding to a second surface of the foot, the relative dimensions of the foot and the cavity being such that when the foot is inserted into the cavity with the equalizing pad between the first surface and the surface corresponding thereto, the at least one other surface is jammed against the second surface, and the equalizing pad is deformed in compression to a thickness which is less than its original thickness. Components for the tool and a method of joining a tamping pad to a shank are also provided.

61 Claims, 3 Drawing Sheets

TAMPING TOOLS

This application relates to tamping tools for use on railways, to components therefore and to a method of attaching a tamping pad to a shank for use in such a machine.

BACKGROUND OF THE INVENTION

As is known, the railway industry requires that the railbed ballast be tamped periodically in order to maintain or correct as required the alignment and elevation of the rails. Complex machines which ride on the rails and carry out the tamping operation as they move along have been developed and are widely used.

The tamping tools which are used on these machines and which actually do the tamping are subject to extreme conditions. The tools are plunged down into the crushed rock ballast and moved horizontally through the ballast, then withdrawn, while at the same time being subjected to a vibratory motion. It is the effect of these violent conditions on the tamping pad at the end of the tool and on the tool shank which gives rise to the present invention.

The tool generally takes the form of a shank which has integral foot at the end thereof and has attached to the foot a tamping pad or shoe. The tamping pad is generally attached to the shaft by bolts, welding or a combination of the two. The tool is therefore for practical purposes a one piece factory made unit. Once installed, the unit is utilized until the pad wears out or the shank breaks. The unit is then consigned to scrap. This is highly wasteful, since the shank will usually outlast the pad. Even if the shank breaks before the pad is worn out, there is a substantial waste factor in scrapping the combined unit since the pad normally represents something in the area of 20% of the value of the tool.

It would therefore be highly advantageous and cost efficient to have a two piece tamping tool in which the tamping pad and the shank can be separated without difficulty in the event of the failure of one of them, so that only the failed part need be replaced. As a general proposition, the railways would find it very advantageous to be able to install and use a single set of shanks for an entire tamping season, replacing only the pads as required.

To date no satisfactory system utilizing readily removable pads has been made available.

Against this background the present invention provides a two piece tamping tool which permits the tamping pad to be readily removed from the shank. The invention also extends to the shank and the tamping pad per se, and to a method of joining the two.

PRIOR ART

The following Canadian Patents ar within the general field of interest:

Canadian Pat. No. 937,455, issued Nov. 27, 1973, to Canron Limited (Corresponds to U.S. Pat. No. 3,677,187 below).

Canadian Pat. No. 1,044,076, issued Dec. 12, 1978, to Edward L. Vick, et al. (Corresponds to U.S. Pat. No. 4,062,291 below).

The following United States patents are within the general field of interest:

U.S. Pat. No. 3,677,187, issued July 18, 1972, to Tamper Inc.

U.S. Pat. No. 4,062,291, issued Dec. 13, 1977, to Edward L. Vick, et al.

U.S. Pat. No. 4,167,141, issued Sept. 11, 1979, to Haywood.

U.S. Pat. No. 4,501,200, issued Feb. 26, 1985, to Canron Corp.

U.S. Pat. No. 4,606,275, issued Aug. 19, 1986, to Grant.

With the exception of Haywood the above inventions pertain to devices in which a tamping pad is bolted or welded or both to a shank. Haywood utilizes a tapered force fit to secure the tamping pad to the shank.

Applicant is also aware of a force fit system known as the Bofors system distributed by Astralloy Wear Technology of Birmingham, Alabama.

BRIEF SUMMARY OF THE INVENTION

There has now been developed a tamping tool and components therefore which provides a practical two piece tool in which the tamping pad can readily be removed from the shank for replacement. An elastomeric pad is utilized to ensure a positive locking force to prevent inadvertent or premature separation of the pad from the shank. A method of joining the pad to the shank to form the elastomeric lock is also provided.

Accordingly, in a first embodiment there is a provided a tamping tool for a railway ballast tamping machine comprising: a shank comprising a shaft, means for fastening the shaft to a tamping machine, and, integral with the shaft, a foot including a first surface; a deformable stress equalizing pad; and a tamping pad adapted to be removably secured to the foot, the tamping pad having a cavity adapted to receive the foot therein, the cavity having a surface corresponding to the first surface of the foot and having at least one other surface corresponding to a second surface of the foot, the relative dimensions of the foot and the cavity being such that when the foot is inserted into the cavity with the equalizing pad between the first surface and the surface corresponding thereto, the at least one other surface is jammed against the second surface and the equalizing pad is deformed in compression to a thickness which is less than its original thickness.

In a further embodiment there is provided a shank for use in a tamping tool for use in a railway ballast tamping machine, the shank comprising a shaft and a foot and wherein the foot includes in at least one surface thereof a depression adapted to receive a stress equalizing pad therein.

In a further embodiment there is provided a tamping pad for use in a tamping tool for a railway ballast tamping machine which tool includes a shank section having a foot, at least one surface of which foot includes a depression therein, and a stress equalizing pad adapted to be positioned within the depression but having a thickness greater than the depth of the depression whereby the pad extends outwardly of the depression beyond the surface, the tamping pad comprising a body member having a tamping surface thereon and having therein a cavity adapted to receive the foot therein, the cavity having a first surface corresponding to at least one surface of the foot and having at least one other surface corresponding to a second surface of the foot, the dimensions of the tamping pad relative to the foot being such that when the foot including the equalizing pad is inserted into the cavity, at least one other surface abuts the second surface and causes the equalizing pad to jam against the first surface and to deform to a thickness which is less than its original thickness but greater than the depth of the depression.

In a further embodiment there is provided for use with a tamping tool for a railway ballast tamping machine in which the tool has a shank including a foot and a tamping pad including a cavity therein, and wherein the exterior of the foot generally conforms in a loose fitting reationship with the interior of the cavity, a method of joining the tamping pad to the foot which comprises associating a stress equalizing pad with at least one of the foot or the cavity, the equalizing pad chosen such that the combined thickness of the equalizing pad and the foot is greater than the corresponding dimension of the cavity, inserting the foot and the equalizing pad into the cavity so as to jam the equalizing pad between the at least one side of the foot and a corresponding side of the cavity with sufficient compressive force to deform the equalizing pad.

GENERAL DESCRIPTION

A number of specific problems arise in the use of tamping tools which have seriously affected attempts to construct a practical two piece tool. For example, both the exterior of the shank and the tamping pad have been constructed of very hard steel, in order to withstand the stresses inherent in the tamping operation. A tight fit has been difficult to obtain between these two hard steel components, because the required tolerances are small. Small deviations will very likely cause the pad to break. Even if the required tolerance could be obtained, the holding power between hard steels would not be sufficient to make a friction fit practicable. Accordingly, it has generally been necessary in known systems to utilize bolts and/or welds to hold the components together.

In the case of bolts, the wear pattern on the pad and shank has generally destroyed the bolt holding ability of the shank. Thus, when a worn pad is removed, a new pad cannot be bolted in place. For this and other reasons, systems utilizing bolted connection between shank and pad have never been successful as replaceable pad systems.

Welding has been equally unattractive because of the necessity for the additional labour and equipment in the field to change pads. Furthermore, if high alloy content steels are utilized for the components, their properties may well be adversely effected by the heat incident to the welding process.

The very high cost of the tamping machine itself and of the labour requirement associated with its operation are highly relevant considerations in this regard. Machine downtime generally is very costly and it is therefore very disadvantageous to utilize any system requiring a substantial amount of time to replace a worn or broken tamping pad. Furthermore, since the tamping machine must work around train schedules, such downtime may result in a gap in train schedules being lost to the machine, thus adding in that way to the downtime.

A tamping tool has now been developed which is able to avoid the necessity for bolts, welding or other similar fastening methods for holding a tamping pad onto a shank. This tool avoids the two problems of breakage due to inexact tolerances between the hard steels and inadequate holding power between hard steels by utilizing at least one deformable stress equalizing pad, preferably an elastomeric pad, between at least one surface of the end part or foot of a shank and a corresponding surface of a cavity in the tamping pad. In inserting the foot into the cavity, sufficient compressive force is applied on the stress equalizing pad to deform it so that it flows into imperfections in the surface of the steels and causes the foot of the shank to jam in the cavity in the tamping pad and to be locked in the jammed position.

The shank for use in the invention comprises a shaft and a foot. The shaft may have various configurations but is preferably of circular cross section. In the most preferred configuration the shaft is of somewhat decreased diameter in an area spaced from the foot and then increases in diameter adjacent the foot.

The foot is preferably integral with the shaft and preferably comprises a modified wedge shape. In this preferred configuration the extremity of the wedge remote from the shaft is truncated. A first one of the broad faces of the wedge is in a plane approximately parallel to the axis of the shaft. That face preferably includes a depression in which an elastomeric pad can be placed.

The sides of the wedge are modified to what is sometimes called a delta wing shape. The face of the wedge which includes the depression is wider than the opposite face. Accordingly, the sides of the wedge are at an angle other than 90° to the two faces.

The tamping pad comprises a thickened steel plate having a flat tamping surface on one side and an integral raised cavity on the opposite side. The cavity conforms in shape to the foot of the shank so the foot can be fitted loosely within it. It is therefore of a modified truncated wedge shape.

In assembling the preferred configuration of the tool, an elastomeric pad is placed in the depression in the first surface of the wedge-shaped end of the foot. The relative dimensions of the foot, the cavity and the elastomeric or stress equalizing pad are chosen such that the pad extends out of the depression beyond the surface of the foot and the combination of the pad and the foot initially have a combined thickness at any point which is greater than the available space in the cavity at a corresponding point. Thus, when the foot is inserted into the cavity, it will eventually reach a point where the cavity walls will exert a force component perpendicular to the elastomeric pad to squeeze it between the foot and the tamping pad. A sufficient force is continued to be applied to cause a deformation of the elastomeric pad causing the pad to flow somewhat into non-uniformities in the wall of the cavity. A material with a very low compression set is chosen for the pad so that the perpendicular force component continues to be exerted between the foot the pad and the cavity after the applied force is removed. The elastomeric pad is deformed to less than its original thickness but not to the extent that there is metal to metal contact between the associated face of the foot and the wall of the cavity.

The foot and the tamping pad are thus effectively held together by reason of the locking effect of the elastomeric pad.

The elastomeric pad also serves to equalize the applied stress over a substantial portion of the joined components.

The use of an elastomeric pad or a similar stress equalizing means is a necessary part of the tamping tool embodiment of the invention.

While the preferred configuration of components has been utilized for the purposes of explanation, it should be noted that other configurations may well be found to be suitable. For example, the elastomeric pad may be utilized in other or different surfaces.

The essential feature is that the configuration be such that when the foot is inserted into the cavity in the tamping pad, a sufficient component of force is directed perpendicular to the elastomeric pad or pads to cause the elastomeric pad or pads to deform at least sufficiently to move into non-uniformities or engineered depressions in the adjacent steel surfaces. The elastomeric pad must have a low compression set.

In the most preferred embodiment of the invention the wall of the cavity in the tamping pad against which the elastomeric pad will be squeezed includes planned irregularities abutting the elastomeric pad. The pad deforms under the applied pressure to flow into the irregularities and become more firmly anchored. In a preferred embodiment these irregularities take the form of a ratchett arrangement comprising a wave-like depression, the profiles of which are biased to allow the pad to more readily be inserted and less readily removed. Thus the configuration is ratchet like in allowing movement more readily in one direction and resisting more strongly in the opposite direction. The size of this depression must not be so deep as to accommodate so much of the elastomeric pad that metal to metal contact occurs in the area of the pad between the foot and the cavity surface.

In the preferred embodiment the shaft is of case hardened steel and the tamper pad of hardened steel.

The stress equalizing elastomeric pad is preferably polyurethane.

BRIEF DESCRIPTION OF THE DRAWINGS

In drawings which illustrated embodiments of the invention.

Figure 1:
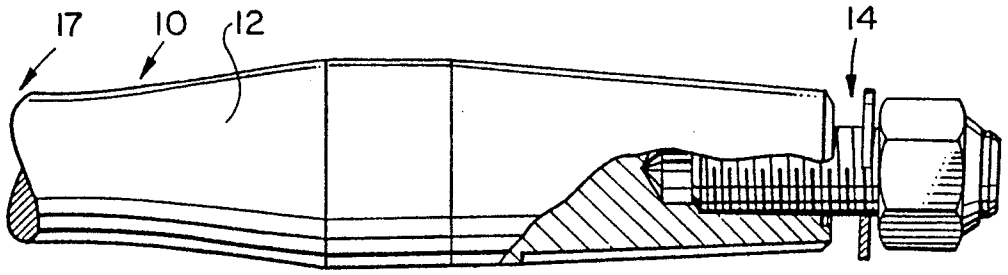
FIG. 1 is a side view of a shank according to the invention.
Figure 4:
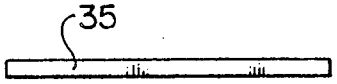
FIG. 4 is an elevation of the pad of FIG. 3.
Figure 5:
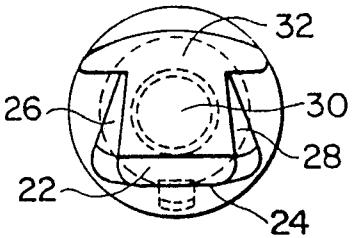
FIG. 5 is an end view of the shank of FIG. 1.
Figure 3:
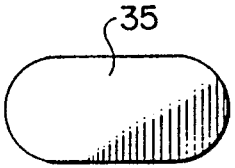
FIG. 3 is a plan view of an elastomeric pad for use in the shank of FIGS. 1 and 2.
Figure 2:
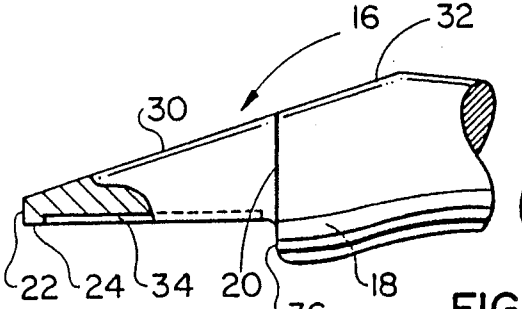
FIG. 2 is a top view of the foot of the shank of FIG. 1.
Figure 2:
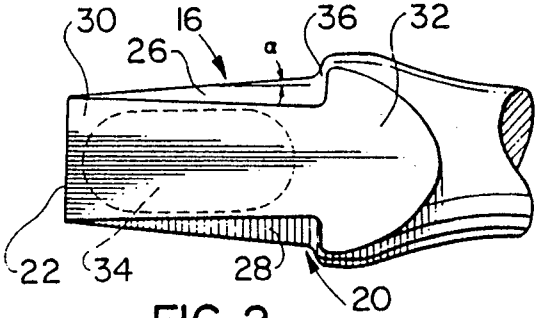

While the invention will be described in conjunction with illustrated embodiments, it will be understood that it is not intended to limit the invention to such embodiments. On the contrary, it is intended to cover all alternatives, modifications and equivalents as may be included within the spirit and scope of the invention as defined by the appended claims.

DETAILED DESCRIPTION OF THE PREFERRED EMBODIMENTS

In the following description, similar features in the drawings have been given similar reference numerals.

The shank 10 comprises a shaft 12 having at one end means 14 for connecting the shaft 12 to a tamping machine and at the other end a foot 16 adapted to be connected to a tamping pad.

The means 14 may vary as required to adapt to the particular tamping machine on which the shank 10 is to be used.

The components should be of good structural steel chosen to withstand the stresses associated with the requirements of the job. The shank 10 itself is preferably of case hardened steel having an outer layer of preferably at least about 60 RC. The core might typically have a hardness range of 38 to 40 RC or with an equivalent tensile range.

It should be emphasized that the materials of the shank and tamping pad may be varied in accordance with good engineering practice to achieve the properties required in the tamping environment.

The profile of the shank is chosen to adequately absorb the varying stresses occuring along its length in the tamping operation. It is desirable to use as little metal as possible consistent with the strength requirements.

In the preferred case the shank has an area 17 of decreased diameter above the foot which then merges into an area 18 of increased diameter adjacent the foot 16. The area of decreased diameter will give to allow extraordinary impact stresses to be absorbed in vibration rather than to act as point stresses levered over the entire length of a rigid shank. Such impact stresses may arise, for example, if the tamping tool contacts a large rock or the like in the ballast. In simplest terms the shank is able to deflect in the area 17 of decreased diameter to thus avoid shearing at points of maximum stress.

The shape of the foot 16 is dictated by a combination of factors including the following. The point of maximum stress on the foot 16 is at the end 20 adjacent the shaft 12. Accordingly, maximum strength and so maximum thickness of material is required. As will be discussed below, a forward taper eases entry of the tamping pad into the ballast, and, accordingly, the cavity in the tamping pad has a forward taper. The foot 16 thus has a conforming forward taper.

The shaft 12 also has the thickened area 18 adjacent foot 16 as noted above to withstand the maximum stresses at that point. The flaring of the shaft 12 from the reduced diameter section 17 to the thickened part 18 provides a further advantageous function in easing withdrawal from the ballast during the tamping operation. The shaft profile is of even greater significance for the following reason.

It is desirable that the placement of appropriate shafts 12 on the tamping machine be as close as possible to the rails on entry into the ballast. The maximum stress on the ballast is directly under the rails, so it is important that the tamping operation be as efficient as possible in that area. In withdrawing from the ballast there is a real danger of severe impact between the rail and the corner 64 of the tamping pad. The profile described allows the reduced diameter part to ride along the rail, if necessary. As the shaft is further withdrawn, the flaring part of the shaft tends to thrust the shaft outwardly as it is cammed by the rail. This outward thrust may generally carry the tool sufficiently far out to avoid contact between the rail and the trailing edge of the tamping pad.

As indicated earlier, the preferred shank profile also means added strength in the shaft at the thickened end 18 adjacent the foot. The shaft may therefore deflect at the narrower part 17 as opposed to shearing under the high stresses at the end 20 of the foot 16.

The foot 16 thus has an overall wedge shape truncated at the extremity 22 remote from shaft 12. The basic wedge shape is modified in that a first surface 24 is wider adjacent shaft 12 than at the extremity 22 of foot 16. This angle of widening $\alpha$ is preferably in the range 0.5–2° and is typically chosen as 1.75°. The sides 26 and 28 of foot 16 are thus at an angle other than perpendicular to the first surface 24 and the opposite surface 30. The effect is magnified in that surface 30 is itself preferably wider at the extremity 22 and narrower adjacent shaft 12. The shape thus given to the foot 16 may be described as a delta wing configuration. This configuration is preferred, since the widened surface 24 adds strength by taking advantage of the generally circular cross section of the end of the shaft 12 and because the sides 26 and 28 offer advantages in maintaining the tamping pad in position as will be discussed below. The various angles in the design are not critical with the exception of the highly preferred maximum on angle $\alpha$ as discussed above. Changes in one angle, however, may dictate corresponding changes elsewhere to maintain the required result.

The first surface 24 of foot 16 is flat and in a plane generally close to parallel to the axis of shaft 12. However, in the most preferred embodiment the plane of surface 24 is rotated slightly out of parallel with the shaft axis. The surface 24 is thus preferably rotated through about 1° so that it is at an angle of about 179° to the axis of the shaft. This angle for surface 24 conforms to the angle of approach of the tamping pad in its horizontal movement within the ballast and aids in imparting a scooping effect to the motion. The altered angle tends to improve the hold between the tamping pad and the foot.

The surface 30 of the foot 16 extends beyond the end 20 of foot 16 to truncate the shaft 12 at 32. This obviously eases the impact of the ballast on the area 18 of shaft 12 as the tool enters the ballast.

Typically, the surface 30 is at an angle of about 18° to the axis of the shaft.

In the preferred case at least one of the surfaces 24, 26, 28 and 30 includes a depression 34 in the surface to receive a deformable stress equalizing pad 35. As illustrated and in the preferred configuration, the depression 34 is in the surface 24. Typically, the surface 24 is about three inches long and varies from a minimum width at the extremity 22 of about 1½ inches. The depression 34 is typically in the order of 2½ inches long by about 1¼ inches wide. Typically the depression 34 is 0.080 inches deep, the pad 35 is about 0.130 inches thick, and the thickness of the pad is decreased by about 0.025 inches on insertion of the foot into the tamping pad.

When the pad 35 is inserted into the depression, it therefore projects beyond the surface 24 by approximately 0.050 inches. In the preferred case the top of the pad projecting from the depression is somewhat convex, to allow the material to flow better on insertion of the foot.

For clarity it is repeated that the elastomeric pad may initially be associated with the tamping pad and with a depression in the tamping pad rather than with foot 16.

In the preferred configuration, the end surface 36 of the area 18 of shaft 12 is machined to form an abutment, and the length of the foot between the extremity 22 and the surface 36 can thus be established within a strict tolerance. The foot 16 is truncated to such a length that the surface 22 never bottoms out on the corresponding surface of the cavity in the tamping pad before the foot is jammed by the cavity.

Figure 6:
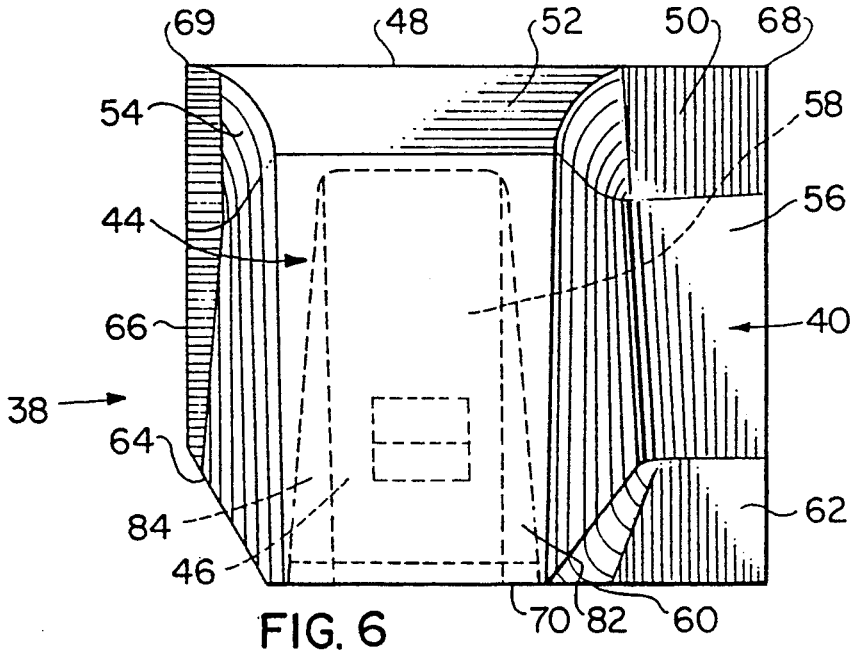
FIG. 6 is a top view of a tamping pad according to the invention.
Figure 7:
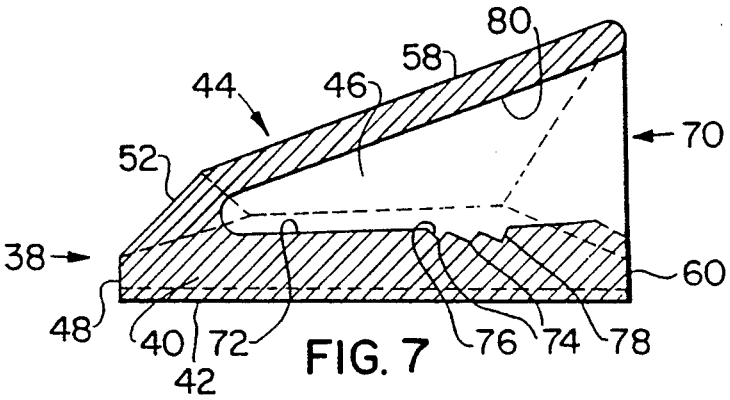
FIG. 7 is a section through the tamping pad of FIG. 6.
Figure 8:
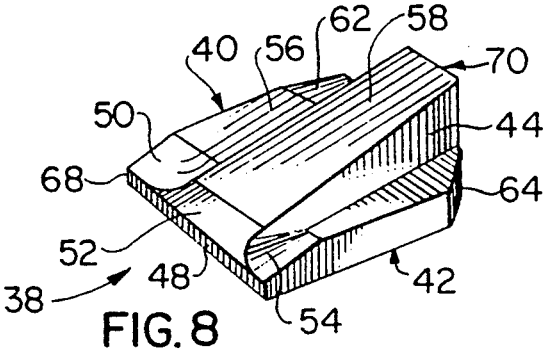
FIG. 8 is a perspective view of the tamping pad of FIG. 6.
Figure 9:
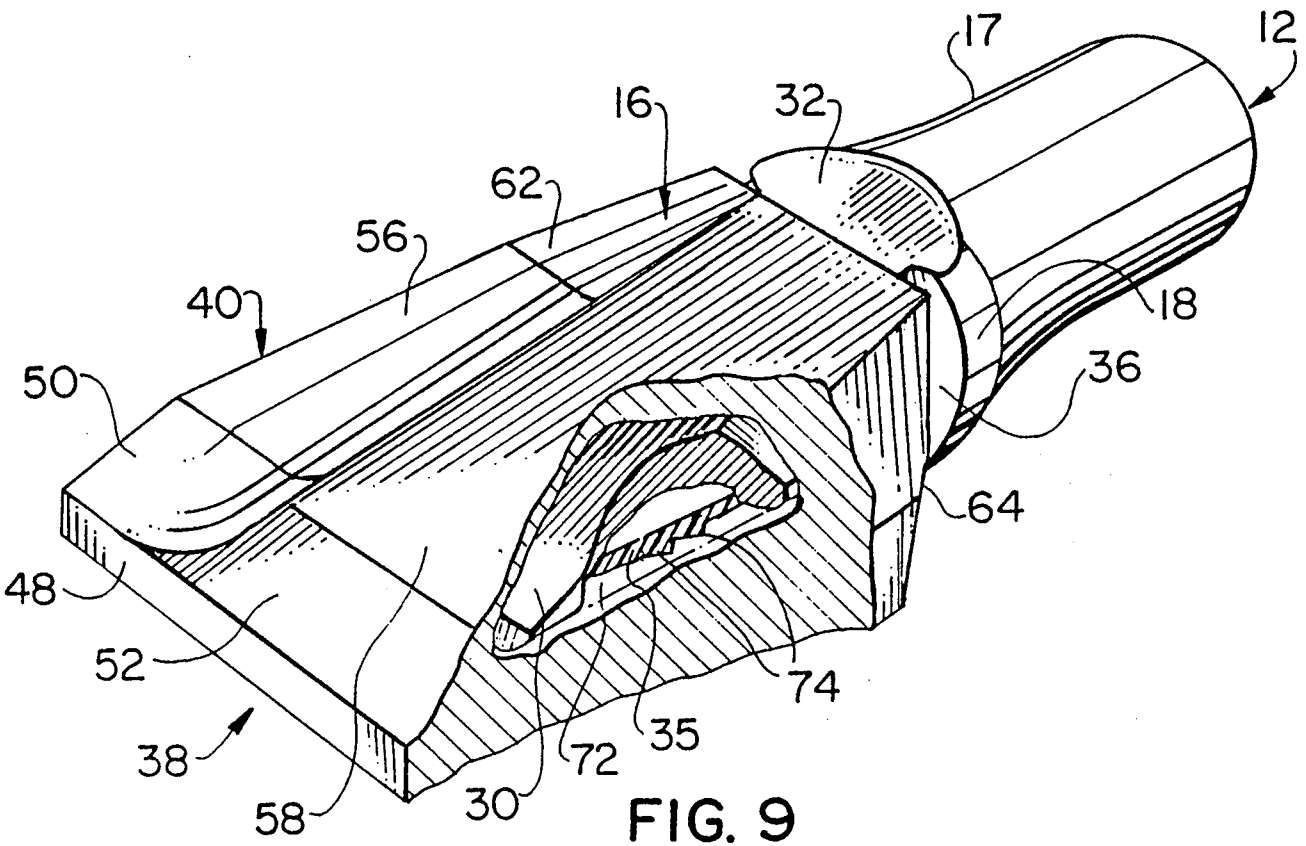
FIG. 9 is a partially cut away perspective view of the tamping pad of FIG. 6 mounted on the shank of FIG. 1.

Turning to FIGS. 6 to 8, a tamping pad is illustrated for use in a tamping tool according to the present invention. The tamping pad 38 comprises a thickened steel plate 40 including a tamping surface 42 on one side thereof and a raised section 44 on the opposite side thereof. Within the raised section 44 is a cavity 46.

The pad 38 is of hardened steel preferably in excess of 60 RC. The pad is preferably a highly wear resistant steel such as CD2.

The overall external configuration of the pad 38 is designed to ease both entry into the ballast and retrieval from the ballast. Thus, the leading edge 48 of plate 40 is truncated to form bevelled areas 50, 52 and 54 between the leading edge 48 and the top surface 56 in the case of areas 50 and 54 and the top surface 58 of the raised section 44 in the case of area 52. The angles and direction of the various bevels are chosen to maximize a fluid entry and to disrupt the ballast as little as possible on withdrawal. Optimizing flow properties by a proper choice of these angles can to a certain extent control the wear pattern on pad 38. Similarly, the trailing surface 60 of plate 40 is truncated to form the bevelled area 62 between the trailing surface 60 and the top surface 56 of plate 40. A further truncation of trailing surface 60 forms the truncated corner 64 between the trailing surface 60 and the side surface 66 of plate 40.

With reference to the discussion above pertaining to the shaft profile, the truncated corner 64 aids the camming effect of the shaft in facilitating withdrawal without impact with the rail. Should impact occur, the effect is minimized by the angle of impact provided by truncated corner 64.

As illustrated most clearly in FIG. 6, the raised area 44 is offset from the centre of the tamping pad 38. Depending upon its particular position on the bank of tools on the tamping machine on which the particular tool is installed, the tamping pad 38 may have the raised area 44 offset to the left or right of or located on the centre line of the pad 38.

Going back to the requirement that the shaft enter the ballast as close to the rail as possible, the offset of the raised area 44 to the left in FIG. 6 allows the shaft 12 to get much closer to a rail on the left side of the tool. It is anticipated in this situation that the wear pattern will be heaviest to the left side of the pad of FIG. 6, wearing back somewhat diagonally from the front left corner 69. For that reason edge 66 of pad 38 and all adjacent areas are preferably thickened to increase wear resistance.

Because of the wear which would otherwise take place on the foot 16 and area 32 of shank 10 when the tool is inserted into the ballast, it is also highly preferred that the raised section 44 be completely enclosed apart from the entry 70 to form the cavity 46.

The cavity 46 preferably includes for each of the surfaces of the foot 16 which includes a depression 34 a corresponding surface. Thus, as illustrated, the surface or wall 72 within cavity 46 corresponds to the surface 24 of the foot 16. By corresponding surface is meant that portion of the corresponding surface which lies adjacent the elastomeric pad 35. When the foot 16 is inserted into the cavity 46, the surface 72 is in contact with the elastomeric pad 35 over the entire area of the elastomeric pad 35.

In the preferred case the interior of the cavity 46 conforms in shape to the foot 16 so that each surface of the foot 16 lies adjacent a wall section of cavity 46.

It is to be noted that in the absence of the elastomeric pad 35 the fit between the foot 16 and the cavity 46 is loose with typically about 0.010 to about 0.025 inches clearance.

Assuming that the foot 16 contains a depression 34 only in surface 24, the specific dimensions of the foot 16 and cavity 46 will be chosen such that the height h at any point along the cavity 46 will be greater than the height at a corresponding point along the foot 16 but less than the total of the height at said point along the foot plus the distance by which the elastomeric pad 35 extends outwardly beyond the surface 24. Therefore, when the foot 16 is inserted into the cavity 46 with the elastomeric pad 35 in place, sufficient force must be exerted between the shank 10 and the tamping pad 38 to cause deformation of the elastomeric pad. If sufficient force is applied, the pad will deform to a thickness less than its original thickness but still greater than the depth of depression 34. There will thus be no metal to metal contact between the surface 24 of the foot 16 and the wall 72 of cavity 46.

As the elastomeric pad is deformed, the elastomeric material is caused to "flow" into the irregularities which will occur in the surface 72 of cavity 46. If the preferred polyurethane elastomer is utilized, the compression strength of the elastomeric pad will be in the area of about eight to ten thousand psi. The preferred size of the pad will give an area of about three square inches, so that the compressive stresses on the cavity 46 will be in the order of thirty thousand pounds. These factors can be varied to obtain the desired holding force. There is therefore clearly a very substantial resistance to withdrawal of the foot 16 from the cavity 46.

In the most preferred embodiment additional holding power is obtained by including irregularities in the surface 72. For example, as illustrated in the drawings, a series of ratchett like depressions 74 are provided extending into the surface 72. The depressions are formed such that the side 76 is at a steeper angle than the side 78 relative t the plane of the surface 72. The depressions 74 are positioned in the surface 72 so that they will lie opposite the elastomeric pad when the foot 16 is inserted. Thus, when the elastomeric pad deforms, it will flow around the ratchett 74. The described configuration of the waves provides by reason of the angles of the sides 76 and 78 much easier insertion than withdrawal, so that additional holding power is obtained.

In order to insert the foot 16 with the elastomeric pad into the cavity 46, it is highly preferable that the components be configured to have a camming effect on the foot 16 as it is inserted, in order to place a strong perpendicular component of force on the elastomeric pad to force it against the surface 72 at the appropriate position. The wedge shape provides such a configuration, since the extremity 22 of foot 16 can readily be positioned well within the cavity 46 before the upper surface or wall 80 of cavity 46 begins to camm the elastomeric pad into contact with the surface 72.

When the tamping tool has been assembled and attached to a tamping machine, the tool will be utilized until the tamping pad 38 is worn to a predetermined extent. The tamping pad will then be removed from the shank 10 and a replacement pad attached.

While the illustrated embodiments show the use of a single elastomeric pad 35 between two surfaces only of the foot and the cavity, additional pads 35 positioned and operating in a similar manner could be placed in other of the surfaces as, for example, between the surface 30 of the foot 16 and the surface 80 of the cavity 46.

Similarly, pads 35 could be inserted into the delta wing surfaces 26 and 28 to engage the corresponding surfaces 82 and 84 of cavity 46.

While the pads 35 have been described in the drawings as being associated initially with the foot, they could also be initially associated with the cavity.

In general terms the invention requires between at least one surface of the foot and a corresponding surface of the cavity a deformable material or structure which has a very high compression strength and a very low compression set. These two requirements define the required component and serve to rapidly eliminate unsuitable possibilities. A spring steel lock washer might be contemplated, for example, provided that the compression strength and compression set were such as to provide sufficient holding power. Modifications would be required to the adjacent surfaces to provide the necessary resistance to pull off of the tamping pad.

Thus it is apparent that there has been provided in accordance with the invention tamping tools for use on railway tamping machines, components therefore and a method of attaching a tamping pad to a shank for use in such a machine that fully satisfy the objects, aims and advantages set forth above. While the invention has been described in conjunction with specific embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the invention.

What I claim as my invention:

1. A tamping tool for a railway ballast tamping machine comprising:

a shank comprising a shaft, means for fastening said shaft to a tamping machine, and, integral with said shaft, a foot including a first surface;

a deformable stress equalizing pad; and a tamping pad adapted to be removably secured to said foot, said tamping pad having a cavity adapted to receive said foot therein, said cavity having a surface corresponding to said first surface of said foot and having at least one other surface corresponding to a second surface of said foot, the relative dimensions of said foot and said cavity being such that when said foot is inserted into said cavity with said equalizing pad between said first surface and said surface corresponding thereto, said at least one other surface is jammed against said second surface, and said equalizing pad is deformed in compression to a thickness which is less than its original thickness.

2. A tamping tool for a railway ballast tamping machine comprising:

a shank comprising a shaft, means for fastening said shaft to a tamping machine, and, integral with said shaft, a foot, at least one surface of which includes a depression therein;

a stress equalizing pad adapted to be positioned within said depression but having a thickness greater than the depth of said depression whereby said pad extends outwardly of said depression beyond said surface; and a tamping pad adapted to be removably secured to said foot, said tamping pad having a cavity adapted to receive said foot therein, said cavity having a surface corresponding to said at least one surface of said foot and having at least one other surface corresponding to a second surface of said foot, the relative dimensions of said foot and said cavity being such that when said foot including said equalizing pad is inserted into said cavity said at least one other surface is jammed against said second surface, and said equalizing pad is deformed in compression to a thickness which is less than its original thickness but greater than the depth of said depression.

3. The tamping tool of claim 2 wherein said foot is of a truncated wedge shape.

4. The shank of claim 3 wherein a first face of said wedge is in a plane substantially parallel to the longitudinal axis of said shaft.

5. The shank of claim 4 wherein the edges of the second face of said wedge are bevelled.

6. The shank of claim 5 wherein said bevel increases progressively back from the leading edge of said wedge.

7. The shank of claim 2 wherein the shaft is of circular cross section and flares from an area of decreased diameter in an area of increased diameter adjacent said foot.

8. The shank of claim 4 wherein the shaft is of circular cross section and includes adjacent said foot an area of increased diameter, the outer extremity of said area extending beyond the plane of said first face of said wedge.

9. The shank of claim 8 wherein a part of said area of increased diameter is truncated by an extension of the second face of said wedge.

10. The shank of claim 3 wherein the leading face of said wedge is rounded at its bottom corners.

11. The tamping tool of claim 2 wherein said tamping pad comprises a body member having a tamping surface thereon and having therein a cavity adapted to receive said foot therein, said cavity having a first surface corresponding to said at least one surface of said foot and having at least one other surface corresponding to a second surface of said foot, the dimensions of said tamping pad relative to said foot being such that when said foot including said equalizing pad is inserted into said cavity, said at least one other surface abuts said second surface and causes said equalizing pad to jam against said first surface and to deform to a thickness which is less than its original thickness but greater than the depth of said depression.

12. The tamping tool of claim 11 wherein said cavity is profiled to cam said equalizing pad against said first surface when said foot is inserted into said cavity.

13. The tamping tool of claim 11 wherein said cavity is a truncated wedge shape.

14. The tamping tool of claim 11 wherein the surface of said wedge shape which forms said first surface widens progressively from the leading to the trailing edge of said wedge to thereby form a pair of angled side surfaces overhanging said first surface in said cavity.

15. The tamping tool of claim 11 wherein said pad includes on said first surface gripping means positioned to be located under said equalizing pad when said pad is jammed against said surface.

16. The tamping tool of claim 11 wherein said gripping mean comprises at least one depression in said first surface.

17. The tamping tool of claim 11 wherein said at least one depressed area is configured to resist withdrawal of said foot after said foot has been inserted into said cavity.

18. The tamping tool of claim 11 including a series of said depressed areas.

19. The tamping tool of claim 11 wherein the depth of said at least one depressed area is less than the thickness of said equalizing pad after said equalizing pad has been deformed.

20. The tamping tool of claim 11 wherein said tamping pad comprises a thick flat plate having tamping and shank protecting surfaces, leading and trailing surfaces, and first and second side surfaces, and wherein said tamping pad includes a generally wedge-shaped area including said cavity and projecting above said shank protecting surface intermediate said first and second side surfaces.

21. The tamping tool of claim 11 wherein said tamping surface is flat and is in a plane substantially parallel to the axis of said shank section when said foot is inserted into said tamping pad.

22. The tamping tool of claim 11 wherein the plane of said tamping surface is rotated slightly out of parallel with the plane of said first surface of said cavity.

23. The tamping tool of claim 11 wherein said wedge-shaped area is offset from the centreline of said tamping surface.

24. The tamping tool of claim 11 wherein the edge between said shank protecting surface and said leading surface is bevelled.

25. The tamping tool of claim 11 in which at least a part of the edge between said shank protecting surface and said trailing surface is bevelled.

26. The tamping tool of claim 11 in which at least one of the edges between said trailing surface and said first and second said surfaces is bevelled.

27. A tamping pad for use in a tamping tool for a railway ballast tamping machine which tool includes a shank section having a foot, at least one surface of which foot includes a depression therein, and a stress equalizing pad adapted to be positioned within said depression but having a thickness greater than the depth of said depression whereby said pad extends outwardly of said depression beyond said surface; said tamping pad comprising a body member having a tamping surface thereon and having therein a cavity adapted to receive said foot therein, said cavity having a first surface corresponding to said at least one surface of said foot and having at least one other surface corresponding to a second surface of said foot, the dimensions of said tamping pad relative to said foot being such that when said foot including said equalizing pad is inserted into said cavity, said at least one other surface abuts said second surface and causes said equalizing pad to jam against said first surface and to deform to a thickness which is less than its original thickness but greater than the depth of said depression.

28. The tamping pad of claim 27 wherein said cavity is profiled to cam said equalizing pad against said first surface when s id foot is inserted into said cavity.

29. The tamping pad of claim 28 wherein said cavity is a truncated wedge shape.

30. The tamping pad of claim 29 wherein the surface of said wedge shape which forms said first surface widens progressively from the leading to the trailing edge of said wedge to thereby form a pair of angled side surfaces overhanging said first surface in said cavity.

31. The tamping pad of claim 27 wherein said pad includes on said first surface gripping means positioned to be located under said equalizing pad when said pad is jammed against said surface.

32. The tamping pad of claim 31 wherein said gripping means comprises at least one depressed area in said first surface.

33. The tamping pad of claim 32 wherein said at least one depressed area is configured to resist withdrawal of said foot after s id foot has been inserted into said cavity.

34. The tamping pad of claim 33 including a series of said depressed areas.

35. The tamping pad of claim 32 wherein the depth of said at least one depressed area is less than the thickness of said equalizing pad after said equalizing pad has been deformed.

36. The tamping pad of claim 27 wherein said tamping pad comprises a thick flat plate having tamping and shank protecting surfaces, leading and trailing surfaces, and first and second side surfaces, and wherein said tamping pad includes a generally wedge-shaped area including said cavity and projecting above said shank protecting surface intermediate said first and second side surfaces.

37. The tamping pad of claim 36 wherein said tamping surface is flat and is in a plane substantially parallel to the axis of said shank section when said foot is inserted into said tamping pad.

38. The tamping pad of claim 37 wherein the plane of said tamping surface is rotated slightly out of parallel with the plane of said first surface of said cavity.

39. The tamping pad of claim 36 wherein said wedge-shaped are is offset from the centreline of said tamping surface.

40. The tamping pad of claim 36 wherein the edge between said shank protecting surface and said leading surface is bevelled.

41. The tamping pad of claim 36 in which at least a part of the edge between said shank protecting surface and said trailing surface is bevelled.

42. The tamping pad of claim 36 in which at least one of the edges between said trailing surface and said first and second sid surfaces is bevelled.

43. A shank for a tamping tool for use in a railway ballast tamping machine, said shank comprising a shaft and a foot of truncated wedge shape said foot including a depression in at least one surface adapted to receive a stress equalizing pad therein, said stress equalizing pad having a thickness greater than the depth of said depression to project from said depression and wherein a first face of said wedge shaped foot is in a plane substantially parallel to the longitudinal axis of said shaft.

44. A shank for a tamping tool for use in a railway ballast tamping machine, said shank comprising a foot including a depression in at least one surface thereof adapted to receive a stress equalizing pad therein, said stress equalizing pad having a thickness greater than the depth of said depression to project from said depression and a shaft of circular cross section flaring from an area of decreased diameter spaced from said foot to an area of increased diameter adjacent said foot.

45. A shank for a tamping tool for use in a railway ballast tamping machine, said shank comprising a shaft and a foot of truncated wedge shaped, said foot including a depression in at least one surface adapted to receive a stress equalizing pad therein, said stress equalizing pad projecting from said depression, such that the thickness of said pad is greater than the depth of said depression, and wherein a leading face of said wedge-shaped foot is rounded at the corners to an oval configuration.

46. The shank of claim 43 wherein said plane is rotated by about 1° out of parallel with said axis to reduce the angle between said surface and said shaft to about 179°.

47. The shank of claim 43 wherein the edges of the second face of said wedge are bevelled.

48. The shank of claim 43 wherein said bevel increases progressively back from the leading edge of said wedge.

49. The tamping tool of claim 2 wherein the original thickness of said equalizing pad is 130/1000 inch.

50. The shank of claim 43 wherein the shaft is of circular cross section and includes adjacent said foot an area of increased diameter, the outer extremity of said area extending beyond the plane of said first face of said wedge.

51. The shank of claim 50 wherein a part of said area of increased diameter is truncated by an extension of the second face of said wedge.

52. The tamping tool of claim 2 wherein the thickness of said equalizing pad when compressed is decreased by about 25/1000 inch.

53. A shank for a tamping tool for use in a railway ballast tamping machine, said shank comprising a shaft, a foot, and at least one stress equalizing pad, and wherein said foot includes a depression in the surface thereof to accommodate each said at least one pad and the thickness of said pad is greater than the depth of said depression to project from said depression.

54. For use with a tamping tool for a railway ballast tamping machine in which said tool has a shank including a foot and a tamping pad including a cavity therein, and wherein the exterior of said foot generally conforms in a loose fitting relationship with the interior of said cavity, a method of joining said tamping pad to said foot which comprises: associating a stress equalizing pad with at least one side of said foot, said equalizing pad chosen such that the combined thickness of said equalizing pad and said foot is greater than the corresponding dimension of said cavity; inserting said foot with said equalizing pad into said cavity so as to jam said equalizing pad between said at least one side of said foot and a corresponding side of said cavity with sufficient compressive force to deform said equalizing pad.

55. The method of claim 54 wherein said compressive force is perpendicular to said corresponding side of said cavity.

56. The method of claim 55 wherein said cavity includes a camming surface opposite said corresponding side and said method includes the step of inserting said foot into said cavity along said camming surface whereby said camming surface applies said perpendicular force to said foot.

57. The tamping tool of claim 2 wherein said stress equalizing pad comprises a material having a very low compression set.

58. The tamping tool of claim 57 wherein said material is polyurethane.

59. The tamping tool of claim 58 wherein said material deforms under a compressive force of 10,000 psi.

60. The tamping of claim 2 wherein the area of said depression and said equalizing pad is about 2.5 to 3.0 square inches.

61. The tamping tool of claim 2 wherein said shaft is case hardened steel.

* * * * *